United States Patent [19]

Lee

[11] Patent Number: 4,739,412

[45] Date of Patent: Apr. 19, 1988

[54] CATHODE RAY TUBE IMPLOSION PROTECTION SYSTEM

[75] Inventor: Sae D. Lee, Buffalo Grove, Ill.

[73] Assignee: Zenith Electronics Corporation, Glenview, Ill.

[21] Appl. No.: 894,984

[22] Filed: Aug. 8, 1986

[51] Int. Cl.[4] ..... H01J 29/87

[52] U.S. Cl. ..... 358/247; 445/2; 445/23; 156/275.5

[58] Field of Search ..... 358/247; 313/477, 478; 220/2.1 A; 445/22, 2, 23; 156/344, 275.5, 275.7

[56] References Cited

U.S. PATENT DOCUMENTS

| | | | |
|---|---|---|---|
| 2,734,142 | 2/1956 | Barnes | 358/247 X |
| 2,999,781 | 9/1961 | Davis | 156/344 |
| 3,130,854 | 4/1964 | Casiari | 358/247 X |
| 3,164,672 | 1/1965 | Spear et al. | 358/247 |
| 4,329,620 | 5/1982 | Lanciano | 358/247 X |

FOREIGN PATENT DOCUMENTS

| | | | |
|---|---|---|---|
| 96637 | 6/1984 | Japan | 445/45 |

*Primary Examiner*—Kenneth J. Ramsey
*Attorney, Agent, or Firm*—Ralph E. Clarke, Jr.

[57] ABSTRACT

A resin bonding system which bonds an implosion protection panel to the faceplate of a CRT tube and is cured by exposure to ultraviolet radiation. The resin bonding system is designed for differential adhesion so that the faceplate separates more easily from the resin than does the implosion protection panel, thus achieving superior implosion performance.

20 Claims, 2 Drawing Sheets

FIG. 4
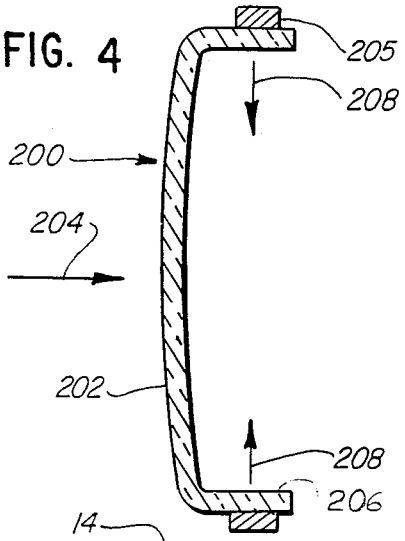
FIG. 5
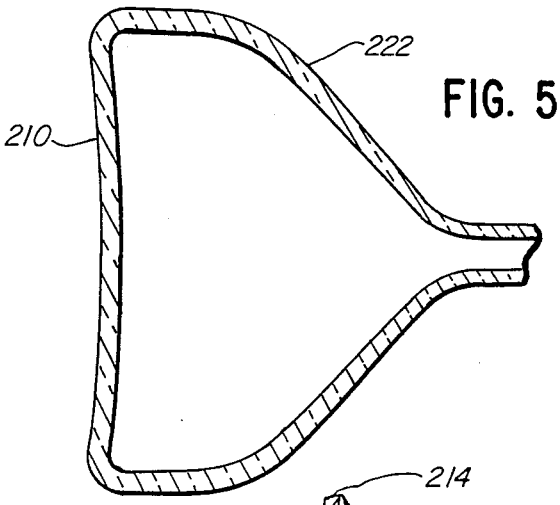
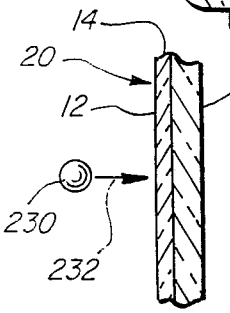
FIG. 6A
$t_1$
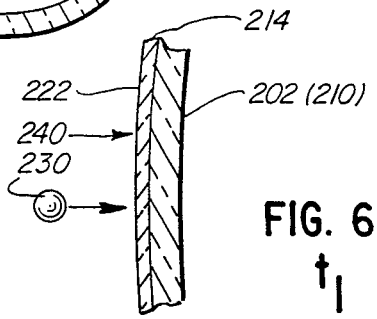
FIG. 6B
$t_1$
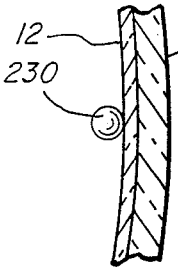
FIG. 7A
$t_2$
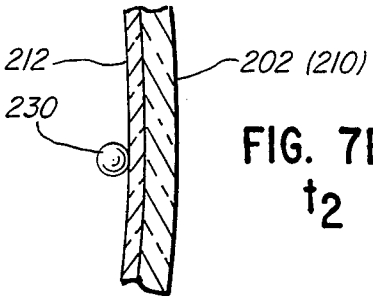
FIG. 7B
$t_2$
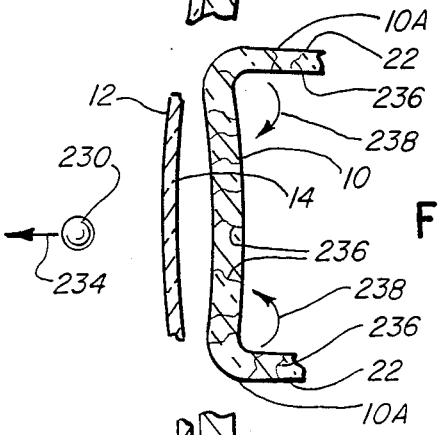
FIG. 8A
$t_3$
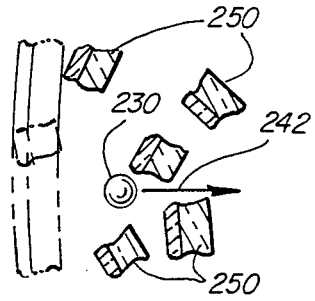
FIG. 8B
$t_3$
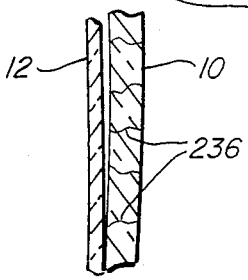
FIG. 9A
$t_4$
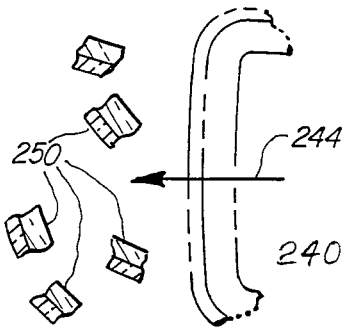
FIG. 9B
$t_4$

CATHODE RAY TUBE IMPLOSION PROTECTION SYSTEM

FIELD OF THE INVENTION

The invention relates to methods and means for bonding an implosion protection panel to the faceplate of a cathode ray tube.

BACKGROUND OF THE INVENTION

The implosion which occurs upon breakage of the envelope of an evacuated cathode ray tube (CRT) is quite dangerous. Impact on the glass faceplate of such a tube can cause the faceplate to shatter into many fragments, which may be violently driven into the interior of the tube by external air pressure. The glass fragments then rebound outwardly and are ejected with sufficient force to cause serious injury to a person standing in front of the tube.

Until recently, all color television tubes have consisted of CRT,s with convexly curved faceplates. Such faceplates resist external air pressure in much the same manner as an arch supports an architectural load, and for that reason prior art methods of implosion protection have proved adequate. But curved faceplates require that the shadow mask employed in color TV systems must also be curved. Recently, a superior color CRT has been invented which employs a flat, tensioned shadow mask and a flat faceplate, and this has resulted in a major improvement in the brightness and/or contrast of the color image.

Unfortunately the implosion protection systems which have been used successfully with curved faceplate tubes have proven inadequate when used with flat faceplates. In particular, when prior art implosion protection systems are tested on the new flat tension mask tubes, they fail to meet UL1418, the relevant safety standard of Underwriters Laboratories, Inc. for television implosion hazards.

Three techniques of implosion protection are presently used with curved faceplates. In one of these, a metal band in hoop tension around the skirt (periphery) of the faceplate exerts a radial compressive force which cooperates with the external air pressure to put the curved faceplate under compression. This system is exemplified by the following U.S. Pat. No. Henry et al U.S. Pat. 2,847,017; Vincent et al. U.S. Pat. No. 2,785,820; and Lange et al. U.S. Pat. No. 3,200,188.

The tension band system described above depends upon the fact that the glass faceplate is under compression. Although brittle, glass is quite strong when it is under compression. The new flat faceplate, however, is bowed slightly inwardly by the effect of external air pressure. Therefore it is somewhat concave, which causes it to be under tension instead of compression, and makes it more vulnerable to breakage. Moreover, upon the occurrence of any rupture in the faceplate, its fragments tend to fly apart explosively because of the centripetal effect of the tension forces.

In another prior art system, known as the resin bond approach, a shell is placed around the faceplate skirt and filled with epoxy. The epoxy glues enough of the faceplate to the funnel (rear portion) of the tube to keep the scattering of glass fragments to a minimum.

Then there is a third approach, which involves securing an implosion protection panel to the front surface of the faceplate together of an adhesive which tightly bonds the two members together to form a monolithic structure. There is a significant body of prior art disclosing the use of bonded panels in connection with curved faceplates, including the following patents:

| | |
|---|---|
| U. S. Patents | |
| Sumiyoshi et al. | 4,031,553 |
| Moulton et al. | 2,596,863 |
| Jackman | 3,007,833 |
| Giacchetti et al. | 3,051,782 |
| Hedler et al. | 3,075,870 |
| Kufrovich | 3,113,347 |
| Casciari | 3,130,854 |
| Anderson | 3,184,327 |
| McGary et al. | 3,265,234 |
| Applegath et al. | 3,315,035 |
| De Gier | 3,422,298 |
| Carlyle et al. | 3,321,099 |
| Lanciano | 4,329,620 |
| Arond et al. | 3,208,902 |
| Bayes et al. | 3,177,090 |
| Barnes | 2,734,142 |
| British Patents | |
| Downing | 875,612 |
| Darlaston et al. | 889,457 |

Attempts to use these prior art approaches with flat tension mask tubes have been unsuccessful. In particular, systems employing implosion protection panels tightly bonded to the front of the faceplate have not performed satisfactorily. High speed videotape motion pictures of test implosions of flat tension mask tubes with such bonded panels show clearly that the entire monolithic implosion-panel-and-faceplate structure disintegrates as a unit upon frontal impact, creating an abundant supply of glass fragments which are fired out the front of the tube at high velocity. The effect is a dangerous blizzard of glass shards.

It has now been discovered, however, that an improvement can be made in the bonded panel approach which dramatically reverses the results of the above-described experiments. This improvement consists in bonding the implosion panel to the faceplate in such a manner that the two will separate under impact. High speed videotape movies of flat tension mask CRT implosion tests, comparing the performance of such a system to that of prior art monolithic panel-faceplate structures, show an astonishing difference. No glass fragments escape the tube in the forward direction at all. The implosion panel survives the impact intact, and although the faceplate is cracked, its fragments are still in place. Subsequent inspection of the tube shows that the cracks have spread from the edge of the faceplate to the funnel of the tube, allowing ambient air to enter from the sides and thus equalize the pressure before the cracked faceplate can collapse under atmospheric pressure.

In addition ultra-violet-curable resin materials are used to bond the implosion panel to the outer surface of the faceplate. These resins permit curing by ultra-violet rays at ambient temperatures, without chemical curing agents, and in a much shorter period of time.

A preferred embodiment of the invention uses at least two layers of different UV-curable resin formulations applied to bond the implosion panel to the faceplate, the two formulations having substantially different levels of adhesion to glass to achieve separation of the implosion panel from the faceplate upon impact.

UV-cured resins have been used in the past to form plastic implosion-protection jackets for CRT faceplates; see British specification No. 889,457. But so far as is known, such resins have not been used to bond a separate implosion panel to such faceplates. Light-cured resins are used to bond two glass panes together in British specification No. 875,612; but there is no known suggestion of using ultra-violet curable materials in the CRT art.

In one specific embodiment of the invention, a first resin layer with a higher level of adhesion may be applied to the inner surface of the implosion panel, and a second resin layer with a lower level of adhesion may be applied to the outer surface of the faceplate, thus allowing the faceplate to separate from the implosion panel upon impact. U.S. Pat. No. 3,184,327 of Anderson employs multiple plastic layers for CRT implosion, and British specification No. 889,457 suggests using for the same purpose multiple plastic layers having different physical properties. But nowhere in the known prior art is there any suggestion that such multiple layers be used to bond an implosion panel to the CRT faceplate, nor any suggestion that the layers have differential adhesion with respect to such a panel and such a faceplate.

The following is a probable explanation for the dramatically improved results observed when the implosion protection system of this invention is employed. Upon frontal impact, the implosion panel and faceplate are both deflected inwardly. The relatively low level of adhesion between the resin bonding layer and the faceplate allows the latter to separate from the implosion panel. The thinner and more flexible implosion panel springs back, and the shock of impact is transferred through the more flexible implosion panel to the less flexible faceplate, which cracks as a result. The flexible resin layer cushions and blunts the impact to some extent. The implosion panel remains intact.

The flexure of the faceplate transfers high stresses to the skirt thereof, where the faceplate is secured to the funnel of the tube and therefore cannot readily flex. As a result, either the tube tends to fracture first in the vicinity of the faceplate skirt where the stress is highest, or if it cracks first at the point of impact, then the cracks quickly propagate to the faceplate skirt. In either case, the cracks tend to radiate quickly into the funnel portion, i.e. along the sides of the tubes, and are not confined to the faceplate. Consequently, atmospheric air enters the tube behind the faceplate and equalizes the pressure before the cracked faceplate can collapse. The faceplate fragments therefore remain in place. If some of them do escape, they will blocked by the still-intact implosion panel in front of the faceplate. The result is that no shards of glass are thrown outwardly.

It should also be noted that salvageability of an imperfect tube is enhanced by the implosion protection system of the present invention. Salvageability is of considerable importance because it permits manufacturers to reclaim a imperfect tube by disassembling it and saving the parts which can be reused. The differential adhesion system of the present invention permits the implosion panel to be easily removed from the faceplate by means of a wedge and mallet. The re-exposed front surface of the faceplate will be of virgin quality.

BRIEF DESCRIPTION OF THE DRAWINGS

Preferred embodiments demonstrating the various objectives and features of the invention will now be described in conjunction with the following drawings, which constitute a part of this specification:

FIG. 4 is a schematic cross-sectional representation of a conventional convex CRT faceplate employing a prior art form of implosion protection, and the atmospheric and other forces acting thereon.

FIG. 5 is a comparable schematic cross-sectional representation of a CRT with a flat faceplate, showing the effect of atmospheric forces thereon.

FIGS. 6A–9A and 6B–9B are schematic representations of the probable sequence of events associated with an implosion, as it affects both a CRT embodying the present invention (FIGS. 6A–9A) and a CRT employing a prior art form of implosion protection (FIGS. 6B–9B).

DETAILED DESCRIPTION OF THE PREFERRED EMBODIMENTS OF THE INVENTION

Figure 1:
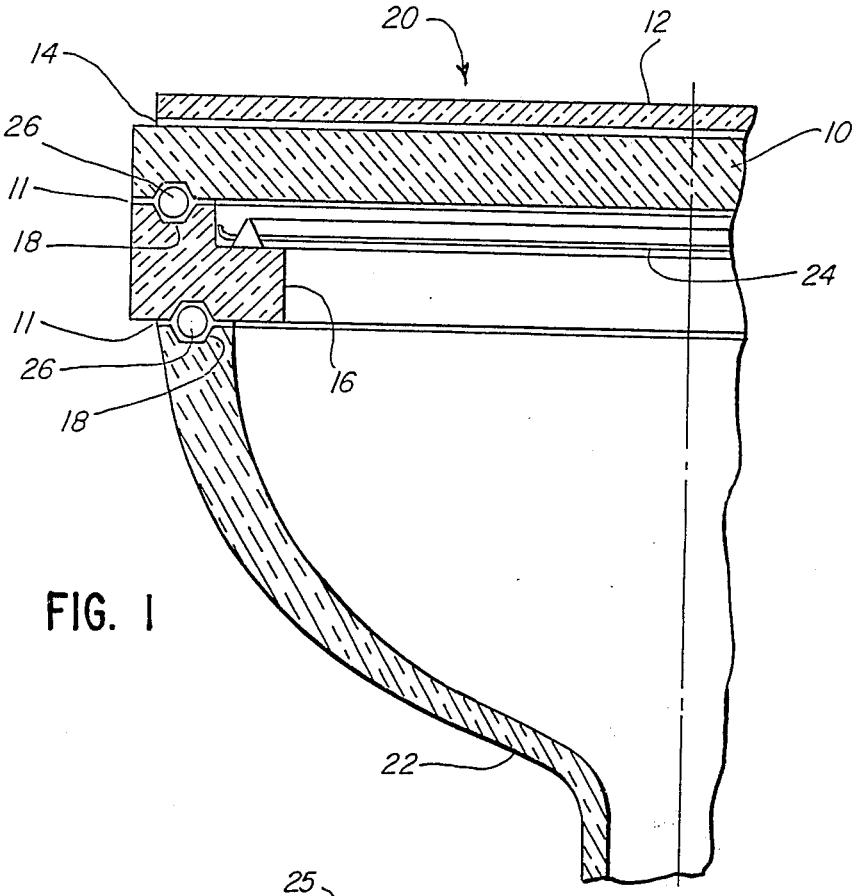
FIG. 1 is a partial longitudinal cross-sectional view of a flat tension mask cathode ray tube having an implosion panel system in accordance with this invention.

Referring to FIG. 1, an evacuated CRT tube 20 comprises a funnel 22, frame 16 and flat faceplate 10 all made of glass. A flat, tensioned color shadow mask 24 is mounted on the frame 16 within the evacuated envelope. Funnel 22 is sealed to frame 16 by means of glass frit in the circumferential sealing area 11 and in the registry grooves 18 which contain a plurality of registry balls 26. Faceplate 10 is sealed to the frame 16 in the identical fashion. A glass implosion panel 12 is bonded to the external surface of faceplate 10 by means of a resin system 14. Implosion panel 12 is substantially thinner and more flexible than the faceplate 10. The implosion panel is commercial double strength window glass with a thickness of an eighth of an inch. The window glass is coated with a thin layer of an anti-reflection material 25 on its outer surface. See FIGS. 2 and 3.

Figure 2:
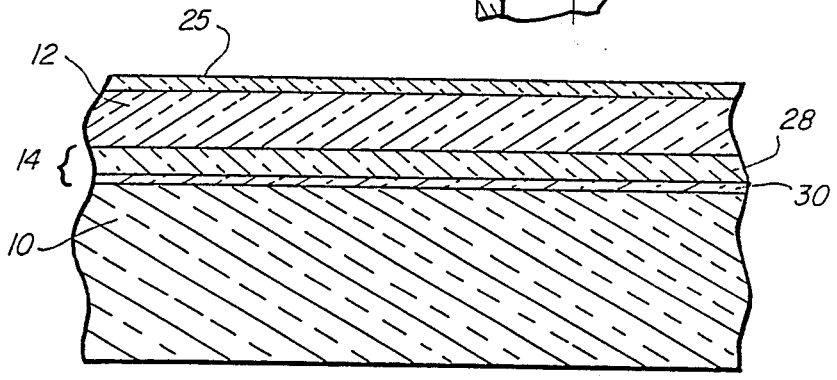
FIG. 2 is an enlarged cross-sectional detail view of the same tube illustrating one embodiment of an implosion panel resin bonding system in accordance with this invention.

The preferred embodiment of the resin system 14 is illustrated in FIG. 2. It has two resin layers 28 and 30 which are different compositions with different adhesive properties. The outer resin layer 28 adheres tightly to the implosion panel 12, and preferably has a thickness in the range from twenty to forty mils. The inner resin layer 30 adheres to the faceplate 10 and adheres weakly to the outer layer 28. The inner layer 30 has a thickness that may vary from 5–15 mils across the face of the tube 20, since the faceplate 10 generally has a slightly concave surface due to the internal vacuum of the CRT.

The resin layers must have a thermal stability sufficient to exceed U.L. standards (which require that laminated tubes withstand 149 degrees Celsius for 50 hours and 154 degrees Celsius for 40 hours). They must also exhibit ultra-violet stability and have an index of refraction that substantially matches the index of refraction of the glass faceplate and implosion panel.

In the remainder of this specification, and the claims appended thereto, the percentages of ingredients mentioned are exclusive of any small amounts of additives which might be included for optical purposes, which would alter the percentage composition somewhat but not enough to affect the adhesive properties of the resin bonding system to any significant extent. For example, a neutral density filtration material might be added to the resin system in order to achieve contrast enhancement, as is known in the CRT art.

The preferred composition of the outer layer 28 includes the following acrylates:

(a) 40 to 90% by weight multifunctional urethane acrylate oligomer, such as urethane polyester acrylate;

(b) 10 to 55% by weight monofunctional acrylic monomer, including—

0 to 30% by weight caprolactone acrylate, 10 to 30% by weight isobornyl acrylate, and 0 to 30% by weight methoxy hexanediol acrylate;

(c) 0 to 20% by weight difunctional acrylic monomer; and (d) 0 to 10% by weight trifunctional acrylic monomer.

The preferred composition of the inner layer 30 includes the following acrylates:

(a) 30 to 70% by weight multifunctional urethane acrylate oligomer, such as urethane polyester acrylate;

(b) 15 to 55% by weight monofunctional acrylic monomer, including—

0 to 30% caprolactone acrylate, and 0 to 25% by weight isobornyl acrylate; and (c) 0 to 50% by weight difunctional acrylic monomer, including—

0 to 25% by weight hexanediol diacrylate, and 0 to 25% by weight triethylene gylcol diacrylate;

(d) 0 to 40% by weight trifunctional acrylic monomer; and (e) 0.2 to 2% by weight of a releasing agent, such as a surfactant.

The above compositions also have added thereto the desired photo-initiators, neutral density filtering agents, etc. While many combinations of adhesive materials can be used which exhibit the required differential adhesion property, some actual examples are as follows:

The following Table I illustrates three examples of preferred compositions for the outer resin layer 28. The percentages are by weight.

TABLE I

| | Outer Resin Layer 28 | | |
|---|---|---|---|
| Ingredient | Example 1 | Example 2 | Example 3 |
| 893 | 68% | 57% | 60% |
| PH8017 | 8.45% | none | none |
| M-100 | none | 14% | 19% |
| IBA | 22.55% | 18% | 20% |
| QM920 | none | 10% | none |
| 184 | 1% | 1% | 1% |

The following Table II illustrates three examples of preferred compositions for the inner resin layer 30. The percentages are by weight.

TABLE II

| | Inner Resin Layer 30 | | |
|---|---|---|---|
| Ingredient | Example 4 | Example 5 | Example 6 |
| 893 | 49% | 60% | 49% |
| M-100 | 28.5% | 16.7% | 28.5% |
| HDODA | 20% | none | none |
| SR272 | none | none | 20% |
| DC193 | 1.5% | 1% | 1.5% |
| IBA | none | 21.3% | none |
| 184 | 1% | 1% | 1% |

In the above Tables I and II the ingredients are as follows:

893 is UVITHANE 893, a polyester urethane acrylate oligomer sold by Morton Thiokol, Inc.

PH8017 is PHOTOMER 8017, a methoxy hexanediol acrylate sold by Diamond Shamrock Chemical Company.

M-100 Tone M-100 is a caprolactone acrylate monomer sold by Union Carbide Corporation.

IBA is isobornyl acrylate sold by Alcolac, Inc. and also by Arco Chemical Corporation.

HDODA is 1,6 hexanediol diacrylate sold by Arco Chemical Company and also by Celanese Chemical Company, Inc.

SR272 is triethylene glycol diacrylate sold by Arco Chemical Company.

184 is IRGACURE 184, a photo-initiator sold by Ciba-Geigy.

QM920 is a trifunctional acrylic monomer sold by Rohm & Hass Company.

DC193 is DOW CORNING 193, a urethane-compatible surfactant sold by Dow Corning, used as a releasing agent.

A preferred embodiment of the resin system 14 is an outer resin layer 28 with the formulation of Example 1 and an inner resin layer 30 having the formulation of either Example 4, or 5 All the formulations described herein work equally well, but they differ as to cost and viscosity. The less viscous formulations can be applied more easily in production.

The differential adhesion properties of the various resin formulations is due to the presence of IBA and M100 in the higher adhesion formulations (Examples 1–3) and the presence of DC193 in the lower adhesion formulations (Examples 4–6).

Bonding of the implosion panel 12 to the faceplate 10 with the double layer resin bonding system of this invention can be achieved in several ways. One method begins with the application of a liquid release layer to a piece of "dummy" glass (a glass panel that will not become part of the CRT 20). The release layer may consist of 5% DC193 by weight dissolved in isopropyl alcohol.

Next, the resin layer 28 is applied in liquid form over the release layer. The implosion panel 12 is then placed on top of the dummy glass in contact with the resin layer 28, with the release layer between the resin layer and the dummy glass. The resin layer 28 is then cured by exposure to ultra-violet light from both sides using a Fusion Systems AEL-1B unit with a D type bulb at an exposure distance of about 13 inches for about 20 seconds from the implosion panel side. After curing, the resin layer 28 adheres strongly to the inner surface of the implosion panel 12.

Next, the dummy glass is removed with the aid of the DC193 release layer. This can be done by inserting a wedge, such as a razor blade, around the edges and then pulling the dummy glass away.

Then, the second resin layer 30 in liquid form is spread over the faceplate 10. The implosion panel with the cured resin layer 28 thereon is placed over the faceplate with the cured resin layer 28 in contact with the liquid resin layer 30. The resin layer 30 is then cured using the Fusion Systems AEL-1B unit with a D type bulb at an exposure distance of about thirteen inches for about 15 seconds from the implosion panel side. The resin layer 30 then adheres to the resin layer 28, and also adheres relatively weakly to the faceplate 10. The bond with the faceplate is sufficient to retain the implosion panel on the faceplate through normal use, packaging and handling of the CRT, but not sufficient to maintain adhesion to the faceplate if the latter is deflected inwardly due to an impact.

Figure 3:
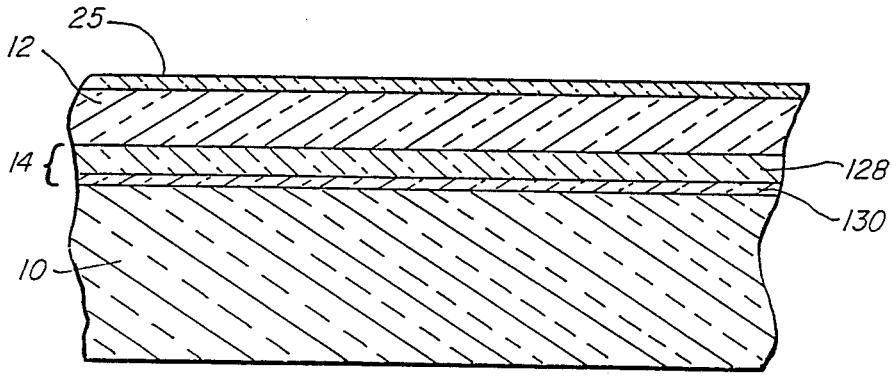
FIG. 3 is another enlarged cross-sectional detail view of the same tube illustrating an alternative resin bonding system in accordance with this invention.

An alternative embodiment of the invention is the single-layer resin system seen in FIG. 3. Example 3 is preferred as the formulation for the single layer of resin 128 which adheres strongly to the implosion panel 12. A release layer 130 is between the resin layer 128 and faceplate 10, permitting the two to separate readily on impact. In manufacturing this embodiment, a thin coat of the release layer 130 (consisting once again of 5% DC 193 by weight dissolved in isopropyl alcohol) is wiped on the faceplate 10. Then the resin material 128 is spread over the faceplate 10. Finally, the implosion panel is placed over the faceplate and the resin layer, and the latter is cured by exposure to the D type bulb described above for about 20 seconds. The implosion panel and faceplate will thereafter adhere to each other during all normal handling and use, but will readily separate at the release layer upon impact.

To understand in detail the theory of operation of this implosion panel bonding system, refer to FIGS. 4–9. FIG. 4 illustrates a conventional CRT glass faceplate 200 having a convexly curved external surface 202. Because of this domed shape, the air pressure 204 exerted on the faceplate is resisted in much the same way that an arch bears an architectural load. The stress is entirely compressive in nature, because it is exerted in the direction to flatten the arch or dome. Such tubes often can do without implosion panels altogether, particularly if an annular tension band 205 is pulled around the faceplate skirt 206 to keep the faceplate in compression and resist the dome flattening tendency of the air pressure 204. The compressive forces exerted by the band 205 are represented by arrows 208. In a typical structure the band 205 can be pulled to a tension of 2000 psi.

Another implosion protection technique which was often used with such convex faceplates was the bonding of an implosion panel over the faceplate, using some type of resin or other adhesive agent. In the past, however, such systems did not employ UV-curable materials, and did not incorporate the concept of differential adhesion.

FIG. 5 schematically illustrates a CRT of modern design having a funnel 222 and flat faceplate 210. Because the faceplate does not have a convex dome configuration as does the faceplate 202 in FIG. 4, it yields slightly to the air pressure 204, which can generate forces of the order of 2000 pounds over a normal size tube face of less then 140 sq. inches. This has the effect of deflecting the flat faceplate 210 slightly inwardly, so that it is actually somewhat concave. As a result, the faceplate 210 is in tension rather than compression, which renders it vulnerable to implosion and fragmentation in the event of a breach of the structural integrity of the faceplate.

To appreciate that fact, consider FIGS. 6A–9A which represent a sequence of events associated with the implosion of a modern flat faceplate CRT which is protected by an implosion panel system employing the differential adhesion concept of this invention, and compare them with FIGS. 6B–9B which represent a corresponding sequence of events in connection with a CRT which is not similarly protected. In FIGS. 6A and B an implosion test ball 230 is impelled toward the front of a CRT. In FIGS. 7A and B it strikes the implosion panel of the CRT and deflects the implosion panel and faceplate inwardly. In FIGS. 8A and B the impact is over and implosion is in progress. In FIGS. 9A and B we see the aftermath of the implosion.

Looking first at FIGS. 6A–9A, we see how a CRT protected in accordance with this invention withstands such an implosion. Here we see the same CRT 20 as in FIGS. 1–3, with its flat faceplate 10 and implosion panel 12 bonded by a differential adhesion resin system 14 of the types described above in connection with either FIG. 2 or FIG. 3. As the test ball 230 moves to the right (arrow 232), in FIG. 6A, approaching the CRT 20 at time t1, the faceplate and implosion panel are substantially flat. When the test ball strikes in FIG. 7A, at time t2, it deflects both the faceplate and implosion panel inwardly of the CRT. In FIG. 8A, at time t3, the implosion panel 12, being thinner and more resilient, springs back outwardly and causes the test ball to rebound to the left (arrow 234). As the panel 12 rebounds, the differential adhesion of the resin system 14 causes the panel 12 and resin system 14 to separate from the faceplate 10. The faceplate 10, under the influence of the impact, remains deflected inwardly and begins to develop cracks 236.

But in spite of these cracks, the faceplate does not disintegrate. This is believed to be because the inward deflection of the faceplate 10 causes the highest stresses to be exerted at the faceplate skirt 10A where it is joined to the funnel 22, since at this location the faceplate is restrained from being deflected. These high stresses in turn cause the cracks 236 to be propagated from the faceplate 10 into the funnel 22. As a result, external air (represented by arrows 238) is allowed to enter the evacuated envelope of the CRT through the funnel 22, behind the faceplate 10, and thus rapidly equalize the pressure on both sides of the faceplate. A similar inrush of air from the front of the faceplate is largely blocked by the still-intact panel 12. This prevents the faceplate, once it is cracked, from being abruptly fragmented by an unopposed pressure wave from the front of the tube.

The final resting position of the faceplate 10 and panel 12, at time t4, after they return to their initial positions, is illustrated in FIG. 9A, where it is seen that the faceplate 10 is cracked but still intact. Even if some glass faceplate fragments were to come flying out towards the front of the tube, they would be prevented from exiting by the still-intact implosion panel 12.

In contrast, the behavior of the prior art structure in FIGS. 6B–9B during a similar implosion test is dramatically different. As seen in FIG. 6B, a prior art CRT 240 has the convex type of conventional faceplate 202 discussed in connection with FIG. 5, although, as indicated by the parenthetical reference numeral 210, it could also be a more modern flat faceplate similar to faceplate 10. In either case, the result of an implosion event as illustrated in FIGS. 6B–9B is essentially the same.

The major difference between the CRT structure of FIGS. 6B–9B and that of FIGS. 6A–9A discussed previously, is that here the implosion panel 212, otherwise similar to panel 12 of FIGS. 1–3, is bonded to the convex faceplate 202 (or flat faceplate 210) by a prior art resin system 214 which adheres strongly to both the panel 212 and faceplate 202 (210), preventing them from separating, and thus requiring them to react as a monolithic unit to the impact of test ball 230.

The test ball is seen approaching the CRT 240 in FIG. 6B at time t1. In FIG. 7B, at time t2, it strikes the panel 212 and deflects the panel and faceplate 202 (210)

inwardly, much as in FIG. 7A. But in FIG. 8B, at time t3, in view of the inability of the panel 212 and faceplate 202 (210) to separate from each other, they both crack and are both immediately swept away in a blizzard of glass shards 250 under the impact of external air pressure the moment the cracking occurs. There is insufficient time to equalize the pressure through the simultaneous entrance of air behind the faceplate 202 (210); compare arrows 238 of FIG. 8A. The panel 212 does not remain intact to block the onslaught of air from the front as panel 12 did in FIG. 8A. The test ball 230 can not rebound from the shattered panel 212 as it did from the intact panel 12 (arrow 234) in FIG. 8A. Rather the ball 230 moves on in the same direction into the interior of the CRT as illustrated by arrow 242. Afterwards, in FIG. 9B, at time t4, the blizzard of glass shards 250 rebounds from the interior of the tube 240 and is expelled forwardly through the unprotected front opening thereof (arrow 244). This last event is what makes the implosion of a prior art tube such a hazard to people in the vicinity.

Differential adhesion can be achieved in various ways, all of which are considered to be within the broad scope of this invention. For example, the resin system 14 could be arranged to adhere to the faceplate 10 and separate from the implosion panel 12 upon impact. In order to accomplish this, the more adherent resin layer 28 of FIG. 2 could be located adjacent the faceplate 10 and the less adherent resin layer 30 could be located adjacent the implosion panel 12; i.e. just the opposite of the arrangement depicted in FIG. 2. Or the arrangement in FIG. 3 could be reversed; putting the resin layer 128 adjacent the faceplate 10 and the release layer 130 adjacent the implosion panel 12. Such reverse arrangements would assure separation of the implosion panel and faceplate on impact, as illustrated in FIG. 8A; the only difference being that the resin system 14 would thereafter adhere to the faceplate 10 instead of the panel 12.

But these reverse arrangements do not perform as well as the illustrated embodiments of FIGS. 2 and 3. It appears that having the resin layer 14 adhere to the implosion panel 12 instead of the faceplate 10 at time t3 (FIG. 8A) is an important factor in keeping the panel 12 intact after separation from the faceplate. Keeping the panel intact is of significant benefit because, as noted previously, it helps to block the inrush of air from in front of the tube until the pressure behind the faceplate 10 can be equalized by leakage through the funnel 22, and it also blocks the possible escape of any faceplate fragments which might fly forward. Consequently the preferred embodiments of the invention are those in which the resin system 14 separates from the faceplate 10 and adheres to the implosion panel 12.

An alternative is to use no adhesive system 14 at all between the faceplate 10 and implosion panel 12. Indeed, some prior art implosion panels are mounted in spaced relationship to the faceplate or are sealed thereto only at the periphery. See, for example, U.S. Pat. Nos. 3,305,123 of Wordby and 3,311,700 of Bulcraig et al., both of which clearly show the implosion panel spaced from the faceplate within the picture display area of the CRT.

Such systems are considered unsatisfactory, however. Even if the Wordby and Bulcraig type of system cited above were modified to place the implosion panel in physical contact with the faceplate, it is doubtful that satisfactory implosion protection would be achieved, since there would be no resin layer to cushion the shock of impact as it is transferred from the implosion panel to the faceplate, and to hold the implosion panel together after impact.

And even if such a system were to perform adequately from the standpoint of implosion protection, it would be unacceptable from an optical point of view, because there would be a microsopically thin air film between the faceplate and implosion panel which would cause reflection of image light and ambient light at the plane of contact, reducing contrast and thereby degrading image quality. Therefore some sort of adhesive system 14 is considered optically necessary; yet for superior implosion protection, ready separability of the implosion panel and faceplate must be achieved. The solution, according to this invention, is to employ a differential adhesion system for both implosion protection and optical coupling between the glass panes 10 and 12.

The combination of properties that is desired in the resin systems of the present invention is as follows. First, the resin layer 28 or 128 should have an elongation and tensile strength that are both relatively high compared with some other types of resins. This combination of properties can be achieved with thermoplastic materials, but only at the cost of impractically long curing times. The UV-curable materials preferred for this invention are thermosetting. In the past, the thermosetting resins used for bonding implosion shields had high elongations (even higher than the present materials) but they had low tensile strength. A high tensile strength is essential for implosion protection and also for separability of the resin system from the faceplate. The materials used in this invention have adequate elongation and a much higher tensile strength than the thermosetting resins previously used in the CRT implosion panel art. The inner resin layer 30, should also have a high tensile strength, but a lower elongation to provide quick release upon impact. This combination of properties is principally due to the amounts of 893 present in all six examples given above. Without this combination of properties there is no known way to keep the implosion panel intact while allowing the faceplate to deflect inwardly and separate from the panel, absorbing and propagating the impact stress radially outwardly toward the funnel 22.

Both resins should also have an index of refraction similar to that of glass, in order to prevent reflection of image and ambient light at the glass resin interfaces, which would result in image degradation.

The UV-curable resins of this invention cure in a matter of seconds, instead of several minutes or hours as in the case of prior art resin materials which are cured by heat or chemical curing agents. In particular, UV-curable resins do not require the admixture of chemical curing agents, as epoxy resins do. In addition UV-curable resin trapped inside the dispensing equipment does not need to be flushed out after a shut-down. Also, it is stable for many months at room temperature, which simplifies the storage of raw materials for production. UV-curable resins are also available in a wider range of viscosities, which offers more flexibility in choosing resin formulations to match production requirements. These resins also have the advantage of closely matching the index of refraction of glass, so as to minimize reflections from the glass-resin interfaces and thus avoid image-degrading reflection of ambient light and image light.

It will now be appreciated that such a system utilizing the concept of differential adhesion to bond an implosion panel to a CRT faceplate allows the faceplate to separate from the implosion panel and drastically reduces the harmful after-effects of implosion. While the invention is of particular importance in connection with modern flat tension mask tubes of the kind described, it will also function in a conventional convex faceplate environment and therefore is not limited to use with flat-faceplate cathode ray tubes.

Still other embodiments of the principles of this invention are contemplated, and the appended claims are intended to cover such other embodiments as are within the spirit and scope of this invention.

The claimed invention is:

1. An evacuated display device comprising a glass faceplate member, a glass implosion protection panel member, and an adhesive system bonding said panel to said faceplate and composed and adapted to adhere substantially more strongly to one of said members than to the other.

2. An evacuated display device comprising a brittle faceplate, an implosion protection panel, and an adhesive system bonding said panel to said faceplate and composed and adapted to adhere substantially more strongly to said panel than to said faceplate.

3. An evacuated display device comprising a brittle faceplate, an implosion protection panel, and an adhesive system bonding said panel to said faceplate, said adhesive system comprising at least two layers of adhesive material adhered to each other, a first one of said layers being adhered to said faceplate, and a second one of said layers being adhered to said panel and composed and arranged to adhere substantially more strongly to said panel than said first layer adheres to said faceplate.

4. An evacuated display device comprising a brittle faceplate, an implosion protection panel, and an adhesive system bonding said panel to said faceplate, said adhesive system comprising at least two layers of adhesive material adhered to each other, a first one of said layers being adhered to said faceplate, and a second one of said layers being adhered to said panel and composed and adapted to adhere substantially more strongly to said panel and to said first layer than said first layer adheres to said faceplate.

5. An evacuated display device comprising a brittle faceplate, an implosion protection panel, and an adhesive system bonding said panel to said faceplate, said adhesive system comprising at least one layer of adhesive material adhered to said panel and a release layer between said adhesive layer and said faceplate.

6. An evacuated display device comprising a relatively thick and less flexible brittle glass faceplate member, a relatively thin and more flexible glass implosion protection panel member, and an adhesive system bonding said panel to said faceplate and composed and adapted to adhere substantially more strongly to one of said members than to the other.

7. The device defined by claims 1, 2, 3, 4, 5 or 6 wherein said adhesive systems includes a UV-curable resin layer.

8. An evacuated display device comprising a brittle glass faceplate member, a glass implosion protection panel member, and at least one layer of UV-curable adhesive material bonding said panel to said faceplate and composed and adapted to adhere substantially more strongly to one of said members than to the other.

9. A method of manufacturing a cathode ray tube having a glass faceplate and a glass implosion panel thereover comprising the steps of:

interposing an adhesive material between said implosion panel and said faceplate;

and curing said adhesive material to bond said implosion panel to said faceplate;

said adhesive material being characterized by having different adhesive qualities relative to said faceplate and said implosion panel respectively.

10. A method of manufacturing a cathode ray tube having a faceplate and an implosion panel thereover comprising the steps of:

applying a first ultraviolet-curable adhesive composition to said implosion panel;

applying a second ultraviolet-curable adhesive composition to said faceplate;

and ultraviolet-curing the first and second adhesive compositions to provide adhesion between each of said adhesive compositions and between said first adhesive composition and said implosion panel and between said second adhesive composition and said faceplate;

said second adhesive composition having a lower level of adhesion to said faceplate than said first adhesive composition has to said implosion panel.

11. A cathode ray tube comprising:

an implosion panel having an inner surface;

a first resin layer strongly bonded to the inner surface of said implosion panel, said first resin layer having a relatively high tensile strength and a relatively high elongation, a thickness of about 20 to 40 mils, and having a composition comprising the following esters in percentages by weight:

(a) 40 to 90% multifunctional urethane acrylate oligomer;

(b) 10 to 55% monofunctional acrylic monomer, including—

0 to 30% caprolactone acrylate, 10 to 30% isobornyl acrylate, and 0 to 30% methoxy hexanediol acrylate;

(c) 0 to 20% difunctional acrylic monomer; and (d) 0 to 10% trifunctional acrylic monomer;

a faceplate having an outer surface, a second resin layer weakly bonded to the outer surface of said faceplate, said second resin having a thickness of about 5 to 15 mils, and having a composition comprising the following esters in percentages by weight:

(a) 30 to 70% multifunctional urethane acrylate oligomer;

(b) 15 to 55% monofunctional acrylic monomer, including—

0 to 30% caprolactone acrylate, and 0 to 25% isobornyl acrylate; and (c) 0 to 50% difunctional acrylic monomer, including—

0 to 30% hexanediol diacrylate, and 0 to 20% triethylene glycol diacrylate;

(d) 0 to 40% trifunctional acrylic monomer; and (e) 0.2 to 2% releasing agent; said implosion panel being bonded to said faceplate by means of said first and second resin layers.

12. The tube of claim 11 wherein the first resin layer is a resin composition selected from the group consisting of:

(a)(i) about 68% urethane polyester acrylate; and (ii) about 31% monofunctional acrylic monomer, of which—
about 22.55% is isobornyl acrylate and
about 8.45% is methoxy hexanediol acrylate; or
(b)(i) about 57% urethane polyester acrylate;
(ii) about 31% monofunctional acrylic monomer, of which—
about 14% is caprolactone acrylate, and
about 18% is isobornyl acrylate; and
(iii) about 10% is trifunctional acrylic monomer; or
(c)(i) about 60% urethane polyester acrylate, and
(ii) about 39% monofunctional acrylic monomer, of which—
about 19% is caprolactone acrylate, and
about 20% is isobornyl acrylate.

13. The tube of claim 11 wherein the second resin layer is a resin composition selected from the group consisting of:
(a)(i) about 49% urethane polyester acrylate;
(ii) about 28.5% caprolactone acrylate; and
(iii) about 20% hexanediol diacrylate;
(iv) about 1.5% DC 193; or
(b)(i) about 60% urethane polyester acrylate; and
(ii) about 38% monofunctional acrylate monomer, of which—
about 16.7% is caprolactone acrylate and
about 21.3% is isobornyl acrylate;
(iii) about 1% DC 193; or
(c)(i) about 49% urethane monomer acrylate;
(ii) about 28.5% caprolactone acrylate;
(iii) about 20% triethylene glycol diacrylate; and
(iv) about 1.5% DC 193.

14. In a cathode ray tube having a transparent faceplate, an implosion system comprising:
a transparent implosion panel which is relatively thinner and more flexible than said faceplate; and
a transparent adhesion system between a front surface of said faceplate and a rear surface of said implosion panel for bonding said panel to said faceplate,
said adhesion system being characterized by being relatively strongly adhered to said rear surface of said implosion panel and relatively weakly adhered to said front surface of said faceplate such that upon impact with the combination of panel and faceplate, said implosion panel decouples from said faceplate at the faceplate front surface and the tube goes to air from the edge or rear of the tube rather than the front, said panel remaining relatively intact to prevent the forward projection of shards from the imploded cathode ray tube.

15. The implosion system defined by claim 14 wherein said adhesion system comprises a single layer of adhesive between said faceplate and said implosion panel and a release agent at the interface between said layer and said front surface of said faceplate.

16. The implosion system defined by claim 14 wherein said adhesion system comprises at least two mutually adhered layers of adhesive between, said implosion panel and said faceplate, characterized by a first one of said layers being in contact with said faceplate and a second one of said layers being in contact with said implosion panel, said first one of said layers having relatively weaker adhesion to said faceplate than said second one of said layers has to said implosion panel.

17. In a cathode ray tube having a flat faceplate which is, due to its flat configuration, deflected inwardly and exists at least partly in a state of high tension when the tube is evacuated, thus predisposing it to extremely violent implosion upon fracturing of the faceplate, an implosion system comprising:
a flat transparent implosion panel which is relatively thinner and more flexible than said faceplate; and
a transparent adhesion system between a front surface of said faceplate and a rear surface of said implosion panel for bonding said panel to said faceplate;
said adhesion system being characterized by being relatively strongly adhered to said rear surface of said implosion panel and relatively weakly adhered to said front surface of said faceplate such that upo impact with the combination of panel and faceplate, said implosion panel decouples from said faceplate at the faceplate front surface. and the tube goes to air from the edge or rear of the tube rather than the front, said panel remaining relatively intact to prevent the forward projection of shards from the imploded cathode ray tube.

18. In a cathode ray tube having a flat faceplate which is, due to its flat configuration, deflected inwardly and exists at least partly in a state of high tension when the tube is evacuated, thus predisposing it to extremely violent implosion upon fracturing of the faceplate, an implosion system comprising:
a flat transparent implosion panel which is relatively thinner and more flexible than said faceplate; and
a transparent adhesion system between a front surface of said faceplate and a rear surface of said implosion panel for bonding said panel to said faceplate,
said adhesion system comprising a single layer of adhesive between said faceplate and said implosion panel and a release agent at the interface between said layer and said front surface of said faceplate.

19. In a cathode ray tube having a flat faceplate which is, due to its flat configuration, deflected inwardly and exists at least partly in a state of high tension when the tube is evacuated, thus predisposing it to extremely violent implosion upon fracturing of the faceplate, an implosion system comprising:
a flat transparent implosion panel which is relatively thinner and more flexible than said faceplate; and
a transparent adhesion system between a front surface of said faceplate and a rear surface of said implosion panel for bonding said panel to said faceplate.
said adhesion system comprising at least two mutually adhered layers of adhesive between said implosion panel and said faceplate, characterized by one layer being in contact with said faceplate and a second layer being in contact with said implosion panel, said first layer having a relatively weaker adhesion to said faceplate than said second layer has to said implosion panel.

20. A method of assembling, and disassembling as necessary, an implosion system for a cathode ray tube, comprising:
providing a transparent implosion panel which is relatively thin and flexible in comparison with the cathode ray tube faceplate; and
introducing between said implosion panel and said faceplate an adhesion system characterized by having the property of adhering relatively strongly to the rear surface of said implosion panel but relatively weakly to the front surface of said faceplate; and
when necessary to salvage the tube, introducing a wedging element between said implosion panel and said faceplate, and impacting said wedging element to drive it between said faceplate and said panel to debond said implosion panel from said faceplate along the relatively weakly adherent interface between said adhesion system and said faceplate front surface.

* * * * *